US006976747B2

(12) United States Patent
Kanda

(10) Patent No.: US 6,976,747 B2
(45) Date of Patent: Dec. 20, 2005

(54) INK-JET PRINTING APPARATUS AND INK-JET PRINTING METHOD

(75) Inventor: Hidehiko Kanda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 10/640,715

(22) Filed: Aug. 13, 2003

(65) Prior Publication Data

US 2004/0032454 A1 Feb. 19, 2004

(30) Foreign Application Priority Data

Aug. 13, 2002 (JP) ..... 2002-235802

(51) Int. Cl.[7] ..... B41J 2/145; B41J 2/15; B41J 29/38

(52) U.S. Cl. ..... 347/40; 347/16

(58) Field of Search ..... 347/40, 12, 9, 347/5, 16, 19

(56) References Cited

U.S. PATENT DOCUMENTS

| | | | | |
|---|---|---|---|---|
| 5,455,610 A | * | 10/1995 | Harrington | 347/43 |
| 5,512,923 A | | 4/1996 | Bauman | 347/15 |
| 5,767,876 A | * | 6/1998 | Koike et al. | 347/43 |
| 5,821,957 A | * | 10/1998 | Berge et al. | 347/43 |
| 5,903,290 A | * | 5/1999 | Nicoloff et al. | 347/43 |
| 6,086,185 A | * | 7/2000 | Inui et al. | 347/143 |

FOREIGN PATENT DOCUMENTS

| | | |
|---|---|---|
| JP | 6-210877 | 8/1994 |

* cited by examiner

*Primary Examiner*—Thinh Nguyen
(74) *Attorney, Agent, or Firm*—Morgan & Finnegan, L.L.P.

(57) ABSTRACT

Printing is performed by scanning a printhead unit in which the first nozzle array on which a plurality of nozzles for discharging the first ink are arrayed and the second nozzle array on which a plurality of nozzles for discharging the second ink are arrayed on a printing medium in a direction crossing to a direction of the nozzle array, the first and second nozzle arrays are arranged side by side in the direction crossing to the direction of the nozzle array so as to locate the first nozzles at the same position in a printing medium convey direction, and the number of nozzles of the second nozzle array is twice or more the number of nozzles of the first nozzle array. At this time, an image is printed by using as a unit a combination of a plurality of first printing/scanning operations of printing by discharging the first ink using only the first nozzle array, a plurality of convey operations of the printing medium by a distance corresponding to the length of the first nozzle array, and one second printing/scanning operation of printing by discharging the second ink using only the number of nozzles of the second nozzle array which is a multiple of the number of nozzles of the first nozzle array. Even an image in which regions to be printed by different inks are adjacent to each other can be printed at a high speed and high quality.

13 Claims, 12 Drawing Sheets

INK-JET PRINTING APPARATUS AND INK-JET PRINTING METHOD

FIELD OF THE INVENTION

The present invention relates to an ink-jet printing apparatus and ink-jet printing method and, more particularly, to an ink-jet printing apparatus and ink-jet printing method which print by scanning a printhead unit having the first nozzle array on which a plurality of nozzles for discharging the first ink are arrayed and the second nozzle array on which a plurality of nozzles for discharging the second ink are arrayed on a printing medium in a direction crossing to the direction of the nozzle array.

BACKGROUND OF THE INVENTION

A printing apparatus having the function of a printer, copying apparatus, facsimile apparatus, or the like, or a printing apparatus used as an output device for a composite electronic device or workstation including a computer, word processor, or the like prints an image on a printing medium such as a paper sheet or thin plastic plate on the basis of image information (including character information or the like). Such printing apparatuses can be classified by the printing method into an ink-jet type, wire dot type, thermal type, laser beam type, and the like.

Of these printing apparatuses, a printing apparatus of an ink-jet type (ink-jet printing apparatus) prints by discharging ink from a printing means (printhead) onto a printing medium. The ink-jet method is superior to other printing methods because the resolution can be easily increased and the ink-jet printing apparatus achieves high speed, quietness, and low cost. On the other hand, needs for color printing have grown, and many color ink-jet printing apparatuses have been developed. As a printhead constituted by integrating and arraying a plurality of printing elements for higher printing speed, the ink-jet printing apparatus uses a printhead in which ink orifices (nozzles) serving as an ink discharge portion and a plurality of liquid channels are integrated. To cope with color printing, the ink-jet printing apparatus generally comprises a plurality of printheads.

FIG. 1 shows the arrangement of a printer part when the printhead prints on a printing sheet surface. In FIG. 1, reference numerals 101 denote ink cartridges. The ink cartridges 101 are comprised of ink tanks which respectively store four color inks, i.e., black, cyan, magenta, and yellow inks, and a printhead 102 having orifices for discharging these inks. FIG. 2 shows orifices arrayed on the printhead 102 when viewed from the z direction. Reference numerals 201 denote orifices which are arrayed in the printhead 102. The orifices are openings at the ends of nozzles, and ink is discharged from the orifices by driving discharge means arranged in the orifices.

Referring back to FIG. 1, reference numeral 103 denotes a sheet supply roller which rotates in a direction indicated by an arrow in FIG. 1 to supply a printing sheet P in the y direction while holding the printing sheet P together with an auxiliary roller 104; 105, sheet feed rollers which feed a printing sheet and also hold the printing sheet P, similar to the rollers 103 and 104; and 106, a carriage which supports the four ink cartridges and moves them along with printing. When no printing is done, or printhead recovery operation or the like is performed, the carriage 106 stands by at a home position (h) represented by the dotted line in FIG. 1.

Before the start of printing, the carriage 106 at the position (home position) in FIG. 1 moves in the x direction upon reception of a printing start instruction, and printing is executed by a plurality of orifices 201 of the printhead 102. When printing ends up to the end of the sheet surface, the carriage returns to the home position and printing is done in the x direction again.

Ink-jet printing apparatuses have recently been used for printing various images. Along with this, the quality of a printed image degrades under specific conditions.

For example, if a plurality of types of inks are discharged onto a printing medium within a short time in a region where black and color images are adjacent to each other, these inks are mixed with each other before absorbed in the printing medium. As a result, color nonuniformity or the like occurs, and the quality of a printed image degrades.

As a method which prevents color nonuniformity of an image, Japanese Patent Laid-Open No. 06-210877 discloses a technique of performing black printing and color printing in different main scanning in a region where black and color images are adjacent to each other, thereby printing a high-quality image free from any color nonuniformity.

In the technique disclosed in Japanese Patent Laid-Open No. 06-210877, a nozzle width used for black printing and a nozzle width used for color printing are set almost equal to each other, and the time lapsed between printing operations is adjusted.

Demands have arisen for a method of preventing degradation of the quality of a printed image by another arrangement when an image having a region where black and color images are adjacent to each other is printed by an ink-jet printing apparatus.

Further, printing disclosed in this reference prolongs the printing time in a case where the number of nozzles (nozzle width) used in color printing is small.

SUMMARY OF THE INVENTION

It is an object of the present invention to provide an ink-jet printing apparatus capable of printing at a high speed and high quality even an image in which regions to be printed by different inks are adjacent to each other.

It is another object of the present invention to provide an ink-jet printing method capable of printing at a high speed and high quality even an image in which regions to be printed by different inks are adjacent to each other.

The present invention is proposed to achieve printing at a high speed and high quality an image in which a region to be printed by the first ink and a region to be printed by the second ink are adjacent to each other, by executing control of printing an image by a combination of printing/scanning of discharging the first ink using only the first nozzle array and printing/scanning of discharging the second ink using only the second nozzle array in a printing apparatus which prints by scanning along the main scanning direction a printhead having the first nozzle array on which a plurality of nozzles for discharging the first ink are arrayed and the second nozzle array on which a plurality of nozzles for discharging the second ink different from the first ink are arrayed.

To achieve the above objects, according to an aspect of the present invention, there is provided an ink-jet printing apparatus which prints on a printing medium by performing a printing operation by scanning a printhead unit having a first nozzle array on which a plurality of nozzles for discharging first ink are arrayed and a second nozzle array on which a plurality of nozzles for discharging second ink are arrayed on the printing medium along a main scanning direction crossing to a direction of the nozzle array, and a conveying operation of the printing medium along a sub-scanning direction crossing to the main scanning direction, wherein the first nozzle array and the second nozzle array are arranged side by side in the scanning direction so as to locate first nozzles at the same position in a convey direction of the printing medium, and the number of nozzles of the second nozzle array is not less than twice the number of nozzles of the first nozzle array, and the apparatus comprises printing control means for printing an image by using as a unit a combination of a plurality of first printing/scanning operations of printing by discharging the first ink using only the first nozzle array, a plurality of convey operations of the printing medium by a distance corresponding to a length of the first nozzle array, and one second printing/scanning operation of printing by discharging the second ink using only the number of nozzles of the second nozzle array which is a multiple of the number of nozzles of the first nozzle array.

To achieve the above objects, according to another aspect of the present invention, there is provided an ink-jet printing method of printing on a printing medium by performing a printing operation by scanning a printhead unit in which a first nozzle array on which a plurality of nozzles for discharging first ink are arrayed and a second nozzle array on which a plurality of nozzles for discharging second ink are arrayed are arranged on the printing medium along a main scanning direction crossing to a direction of the nozzle array, the first nozzle array and the second nozzle array are arranged side by side in a direction crossing to the nozzle array direction so as to locate first nozzles at the same position in a convey direction of the printing medium, and the number of nozzles of the second nozzle array is not less than twice the number of nozzles of the first nozzle array, and a conveying operation of the printing medium along a sub-scanning direction crossing to the main scanning direction, comprising: printing an image by using as a unit a combination of a plurality of first printing/scanning operations of printing by discharging the first ink using only the first nozzle array, a plurality of convey operations of the printing medium by a distance corresponding to a length of the first nozzle array, and one second printing/scanning operation of printing by discharging the second ink using only the number of nozzles of the second nozzle array which is a multiple of the number of nozzles of the first nozzle array.

More specifically, according to the present invention, in an ink-jet printing apparatus which prints by scanning a printhead unit having the first nozzle array on which a plurality of nozzles for discharging the first ink are arrayed and the second nozzle array on which a plurality of nozzles for discharging the second ink are arrayed on a printing medium in a direction crossing to a direction of the nozzle array, the first and second nozzle arrays are arranged side by side in the direction crossing to the direction of the nozzle array so as to locate the first nozzles at the same position in a printing medium convey direction, and the number of nozzles of the second nozzle array is twice or more the number of nozzles of the first nozzle array, an image is printed by using as a unit a combination of a plurality of first printing/scanning operations of printing by discharging the first ink using only the first nozzle array, a plurality of convey operations of the printing medium by a distance corresponding to the length of the first nozzle array, and one second printing/scanning operation of printing by discharging the second ink using only the number of nozzles of the second nozzle array which is a multiple of the number of nozzles of the first nozzle array.

With this arrangement, printing using the first ink and printing using the second ink are executed in different scanning operations. Mixture of the two inks before fixation onto a printing medium can be prevented even at a portion where a region to be printed by the first ink and a region to be printed by the second ink are adjacent to each other.

Even an image in which regions to be printed by different inks are adjacent to each other can be printed at a high speed and high quality.

The printing control means may print an image by scanning in both forward and backward directions.

The nozzle which discharges the second ink may be large in discharge amount for one operation than the nozzle which discharges the first ink.

Preferably, the second ink is smaller in permeability to a printing medium than the first ink.

In this case, a Ka value of the second ink in a Bristow method may be smaller than a Ka value of the first ink in the Bristow method.

The second ink may include black ink, and the first ink may include ink for color printing.

The number of nozzles of the second nozzle array may be twice the number of nozzles of the first nozzle array.

In this case, the printing control means may print an image by sequentially performing the second printing/scanning, the first printing/scanning, conveyance of the printing medium by the distance, the first printing/scanning, and conveyance of the printing medium by the distance, or print an image by sequentially performing the first printing/scanning, the second printing/scanning, conveyance of the printing medium by the distance, the first printing/scanning, and conveyance of the printing medium by the distance.

Preferably, the ink-jet printing apparatus further comprises determination means for determining whether an image to be printed has a portion where a region to be printed by the first ink and a region to be printed by the second ink are adjacent to each other, and when the determination means determines that the portion where the regions are adjacent to each other exists, image printing by the printing control means is performed.

To achieve the above objects, according to still another aspect of the present invention, there is provided an ink-jet printing apparatus which prints on a printing medium by performing a printing operation by scanning a printhead unit having a first nozzle array on which a plurality of nozzles for discharging first ink are arrayed and a second nozzle array on which a plurality of nozzles for discharging second ink are arrayed on the printing medium along a main scanning direction crossing to a direction of the nozzle array, and a conveying operation of the printing medium along a sub-scanning direction crossing to the main scanning direction, wherein the first nozzle array and the second nozzle array are arranged side by side in the scanning direction so as to locate first nozzles at the same position in a convey direction of the printing medium, and a length of the second nozzle array in the sub-scanning direction is not less than twice a length of the first nozzle array in the sub-scanning direction, and the apparatus comprises printing control means for printing an image by using as a unit a combination of a plurality of first printing/scanning operations of printing by discharging the first ink using only the first nozzle array, a plurality of convey operations of the printing medium by a distance corresponding to the length of the first nozzle array in the sub-scanning direction, and one second printing/scanning operation of printing by discharging the second ink using, of the nozzles of the second nozzle array, only nozzles which correspond to a multiple of the length of the first nozzle array in the sub-scanning direction.

To achieve the above objects, according to still another aspect of the present invention, there is provided an ink-jet printing method of printing on a printing medium by performing a printing operation by scanning a printhead unit in which a first nozzle array on which a plurality of nozzles for discharging first ink are arrayed and a second nozzle array on which a plurality of nozzles for discharging second ink are arrayed on the printing medium along a main scanning direction, the first nozzle array and the second nozzle array are arranged side by side in the main scanning direction crossing to a direction of the nozzle array so as to locate first nozzles at the same position in a convey direction of the printing medium, and a length of the second nozzle array in a sub-scanning direction crossing to the main scanning direction is not less than twice a length of the first nozzle array in the sub-scanning direction, and a conveying operation of the printing medium along the sub-scanning direction, comprising: printing an image by using as a unit a combination of a plurality of first printing/scanning operations of printing by discharging the first ink using only the first nozzle array, a plurality of convey operations of the printing medium by a distance corresponding to the length of the first nozzle array in the sub-scanning direction, and one second printing/scanning operation of printing by discharging the second ink using, of the nozzles of the second nozzle array, only nozzles which correspond to a multiple of the length of the first nozzle array in the sub-scanning direction.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Figure 1:
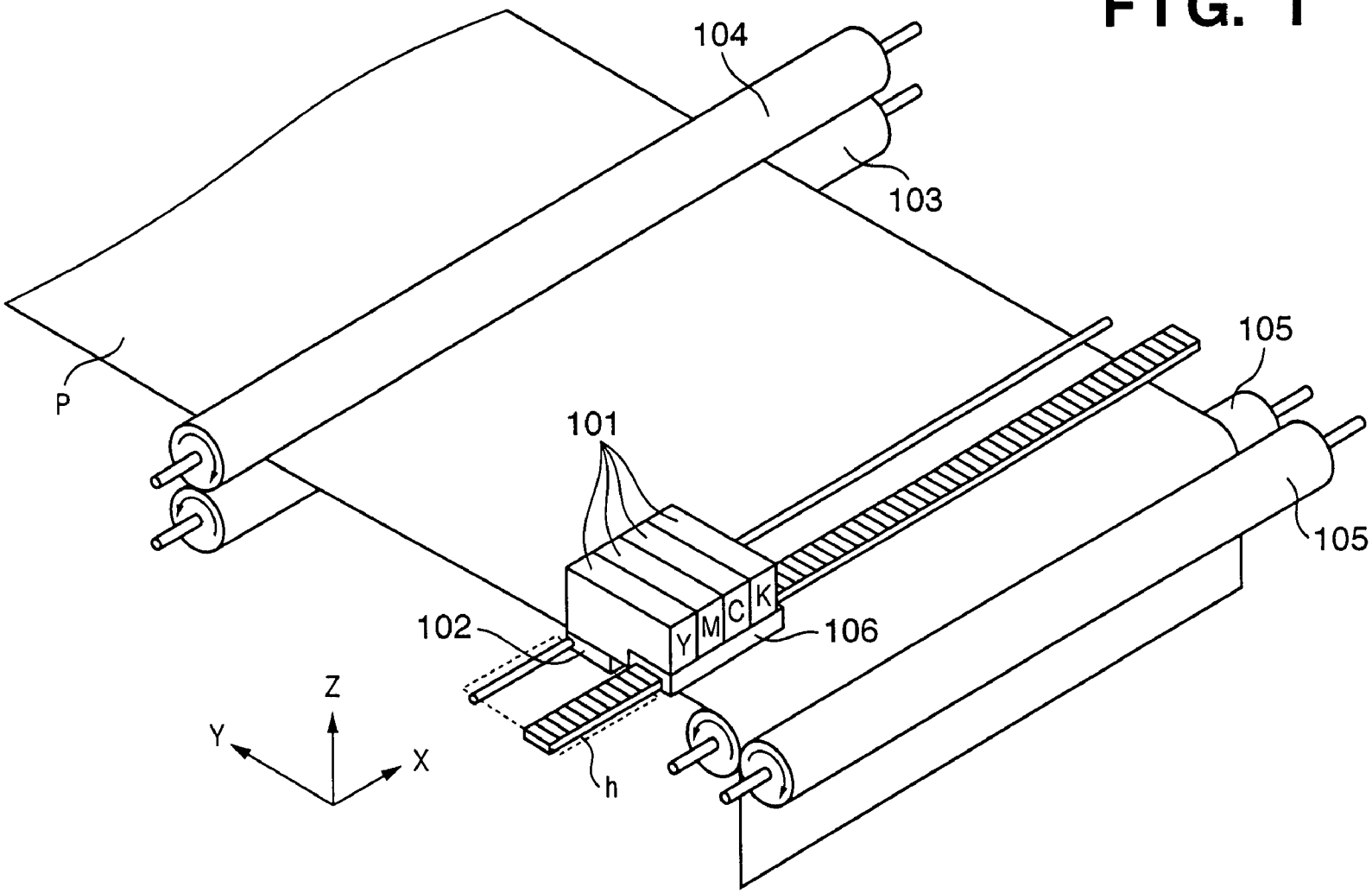
FIG. 1 is a perspective view showing the schematic arrangement of the printer part of an ink-jet printing apparatus.
Figure 2:
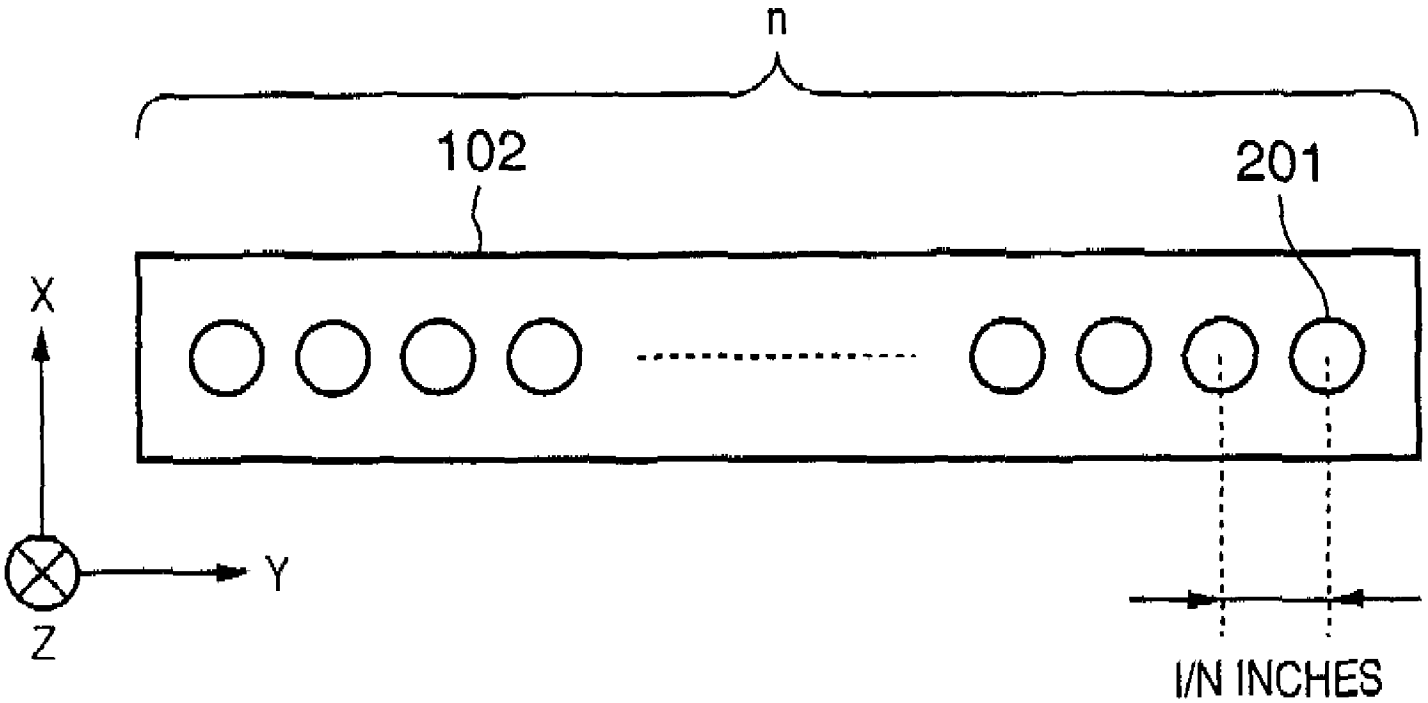
FIG. 2 is a view schematically showing the orifice array of a printhead.
Figure 3:
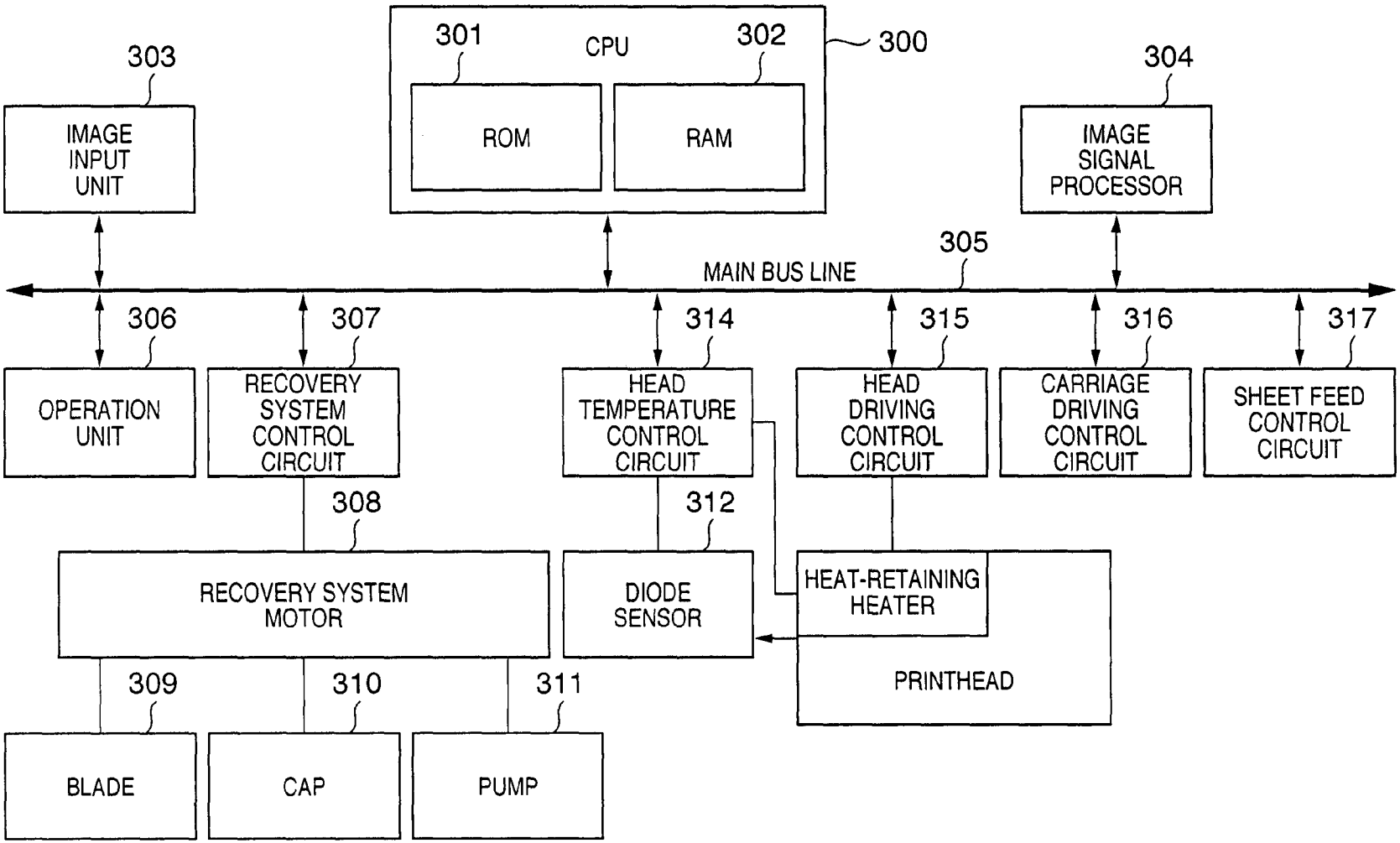
FIG. 3 is a block diagram showing the control arrangement of an ink-jet printing apparatus according to the present invention.

FIG. 3 is a block diagram showing the control arrangement of an ink-jet printing apparatus according to an embodiment of the present invention. The mechanical arrangement of the ink-jet printing apparatus according to the embodiment is the same as that shown in FIG. 1. That is, the embodiment can be applied to a printing apparatus which prints on a printing medium by performing printing operation of scanning the printhead on the printing medium along the main scanning direction and performing printing, and convey operation of conveying the printing medium along the sub-scanning direction crossing to the main scanning direction.

The arrangement shown in FIG. 3 is roughly divided into software system processing means such an image input unit 303, corresponding image signal processor 304, and CPU (Central Processing Unit) 300 which access a main bus line 305, and hardware system processing means such as an operation unit 306, recovery system control circuit 307, ink-jet head temperature control circuit 314, head driving control circuit 315, carriage driving control circuit 316 in the main scanning direction, and sheet feed control circuit 317 in the sub-scanning direction.

The CPU 300 generally comprises a ROM 301 and RAM (Random Access Memory) 302. The CPU 300 gives proper printing conditions to input information, drives a printhead 313, and performs printing. The RAM 302 stores in advance a program for executing a head recovery timing chart. If necessary, recovery conditions such as preliminary discharge conditions are supplied to the recovery system control circuit 307, printhead, heat-retaining heater, and the like. A recovery system motor 308 drives the printhead 313, and a cleaning blade 309, cap 310, and suction pump 311 which face the printhead 313 at an interval. The head driving control circuit 315 executes driving conditions for the ink discharge electrothermal transducer of the printhead 313, and causes the printhead 313 to perform general preliminary discharge and printing ink discharge.

A heat-retaining heater is mounted on a board which supports the ink discharge electrothermal transducer of the printhead 313. The heater can adjust the ink temperature in the printhead to a desired set temperature. A diode sensor 312 is also mounted on the board, and measures the substantial ink temperature in the printhead. The diode sensor 312 may be arranged not on the board but outside or near the printhead.

Several embodiments of the present invention based on the ink-jet printing apparatus having the above arrangement will be described.

(First Embodiment)

Figure 4:
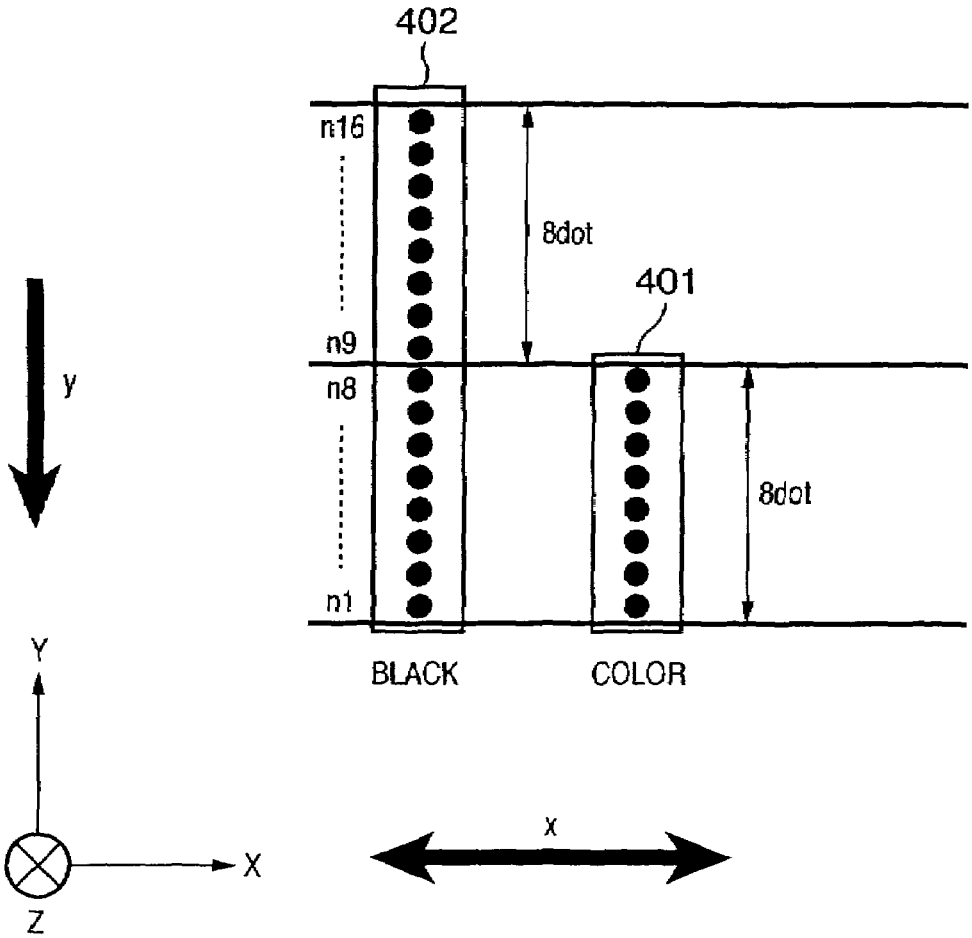
FIG. 4 is a view showing the arrangement of a printhead according to the first embodiment of the present invention.

FIG. 4 is a view showing the arrangement of a printhead according to the first embodiment of the present invention. As shown in FIG. 4, the first embodiment employs a color ink printhead 401 and black ink printhead 402. The printhead 401 which discharges color ink has eight orifices (eight nozzles) n1 to n8 at a density N=600 per inch (600 dpi (dots per inch)), and discharges about 5 pl of ink from each orifice. The printhead 402 which discharges black ink has 16 orifices (16 nozzles) n1 to n16 at a density N= 600 per inch (600 dpi), and discharges about 30 pl of ink from each orifice. Since orifices are arrayed at the same density in the printheads 401 and 402, but the numbers of arrayed orifices are different, the widths of regions printable by the printheads in one scanning (in this case, printing widths along the orifice array direction) are different.

In FIG. 4 and drawings according to the following embodiments, only one printhead is illustrated as a color ink printhead. A plurality of color ink heads may be mounted in a direction (main scanning direction) indicated by the arrow x in FIG. 4 in correspondence with the types of color inks used for printing. For example, when the present invention can be applied to an ink-jet printing apparatus which prints by discharging four, black, yellow, magenta, and cyan color inks used generally, three printheads 401 shown in FIG. 4 are arranged in the x direction. When a plurality of inks with different densities are used for each color ink, a plurality of printheads may be mounted in accordance with the settings.

In FIG. 4 and drawings according to the following embodiments, ● and ○ in each printhead represent orifices, ● represents an orifice used for printing in a corresponding embodiment, and ○ represents an orifice not used for printing.

In the first embodiment, as shown in FIG. 4, all the eight orifices n1 to n8 of the color ink printhead 401 are used for ink discharge. All the 16 orifices n1 to n16 of the black ink printhead 402 are used for ink discharge.

The two printheads have a positional relationship in which orifices having the same number are arranged at the same position in the sub-scanning direction indicated by the arrow y in FIG. 4 and at a predetermined interval in the main scanning direction indicated by the arrow x in FIG. 4. The arrow y indicates a direction along the arrow (the same arrow as the arrow indicating a direction in FIG. 1) Y at a lower left portion in FIG. 4. Also, the arrow x indicates a direction along the arrow X at the lower left portion in FIG. 4.

The Ka value in the Bristow method for black ink used in the first embodiment is 1.0 [$ml \cdot m^{-2} \cdot msec^{-1/2}$], and the Ka value in the Bristow method for color ink is 7.0 [$ml \cdot m^{-2} \cdot msec^{-1/2}$]. Black ink is lower in permeability than color ink.

Figure 8:
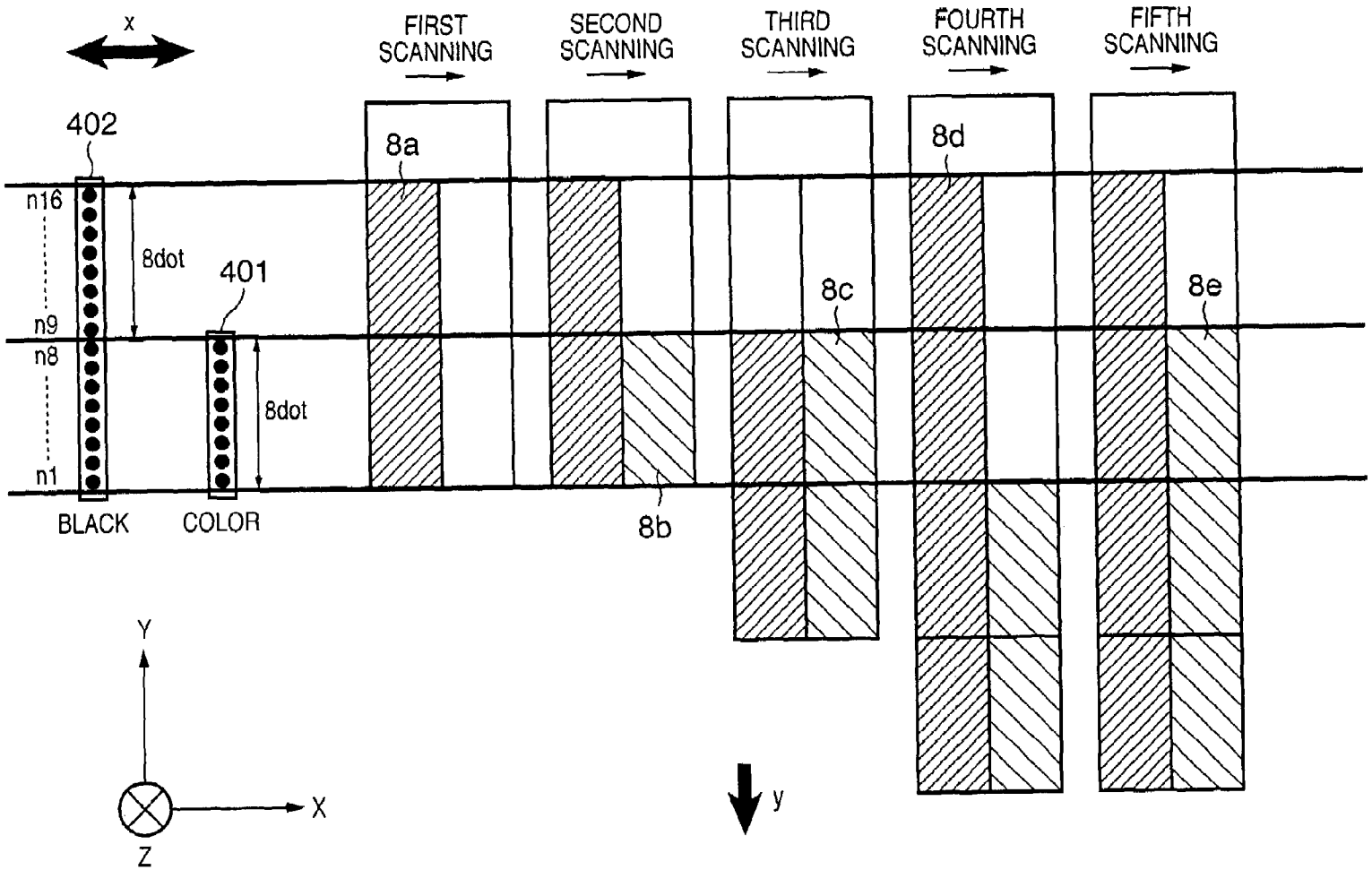
FIG. 8 is a view showing a printing state in each scanning according to the first embodiment of the present invention.

A printing method according to the first embodiment of the present invention will be explained with reference to FIG. 8 showing a printing state in each scanning.

In the first main scanning (to be referred to as the first scanning hereinafter), a black printing region 8*a* is printed by one pass in a forward direction indicated by an arrow using all the 16 nozzles of the black ink printhead 402. The printhead is moved in the backward direction so as to return it to the printing start position, and printing is performed in the second main scanning without conveying the printing medium in the sub-scanning direction.

In the second scanning, a color printing region 8*b* in FIG. 8 is printed by one pass in a forward direction indicated by an arrow using all the eight nozzles of the color ink printhead 401. The printhead is moved in the backward direction so as to return it to the printing start position, and the printing medium is conveyed in the sub-scanning direction by driving the sheet feed motor by a distance of 8 dots at 600 dpi.

In the third scanning, a color printing region 8*c* in FIG. 8 is printed by one pass in a forward direction indicated by an arrow using all the eight nozzles of the color ink printhead 401, similar to the second scanning. The printhead is moved in the backward direction so as to return it to the printing start position, and the printing medium is conveyed in the sub-scanning direction by driving the sheet feed motor by a distance of 8 dots at 600 dpi.

In the fourth scanning, a black printing region 8*d* in FIG. 8 is printed by one pass in a forward direction indicated by an arrow using all the 16 nozzles of the black ink printhead 402, similar to the first scanning. The printhead is moved in the backward direction so as to return it to the printing start position, and printing is performed in the fifth scanning without conveying the printing medium in the sub-scanning direction.

In the fifth scanning, a color printing region 8*e* in FIG. 8 is printed by one pass in a forward direction indicated by an arrow using all the eight nozzles of the color ink printhead 401, similar to the second scanning.

In this manner, according to the first embodiment, the length of the orifice array of the black ink printhead is twice that of the color ink printhead. That is, the printing width of the black ink printhead is twice that of the color ink printhead. When a printing medium is conveyed, a region printed in one printing/scanning operation by the black ink printhead and a region printed in two printing/scanning operations by the color ink printhead are formed with the same size by using the two printheads in which orifices having the same number are arrayed from the start position. Printing of a black region and printing of a color region with the same size are alternately executed. In each main scanning, printing is done using only either black or color ink. In the first embodiment, printing is performed in an order of black printing, color printing, and color printing.

In the first embodiment, black ink having a small Ka value in the Bristow method is applied to a printing medium prior to color ink having a large Ka value in the Bristow method. This improves permeability and fixation on a printing medium, and ink blur between the black and color regions can be effectively prevented.

As described above, according to the first embodiment, at least two printheads print in different main scanning operations, and even an image in which black and color printing regions are adjacent to each other can be printed at a high speed and high quality.

(Modification to First Embodiment)

In the first embodiment, any main scanning is one-way printing in the forward direction. The speed can be further increased by reciprocal printing in which printing is performed on the return pass in even-numbered main scanning.

In the first embodiment, the intervals between the orifices of the black and color printheads are 600 dpi. However, the interval is not limited to this, and the interval between the orifices of the color printhead may be doubled to 1,200 dpi to double the number of orifices without changing the length of the orifice array.

Figure 5:
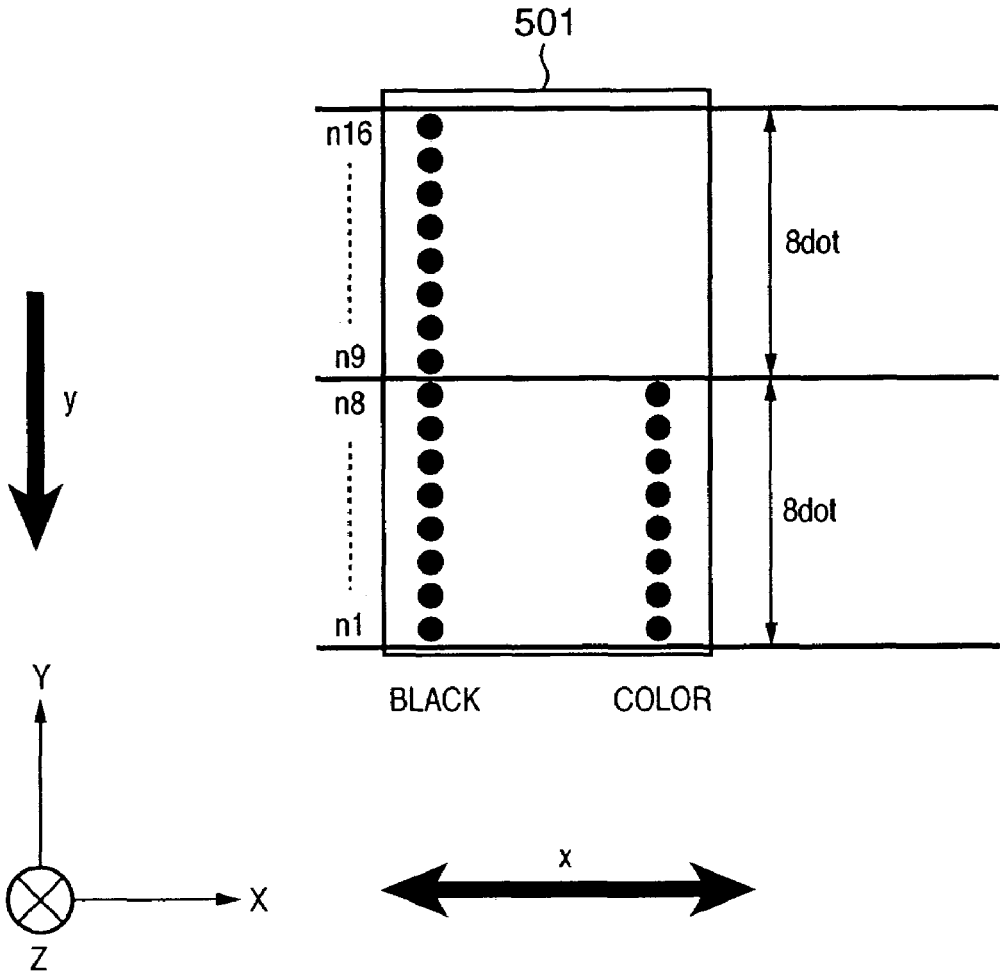
FIG. 5 is a view showing another arrangement of the printhead which can be applied to the present invention.

In the first embodiment, printing uses the two printheads, i.e., color ink printhead 401 and black ink printhead 402 as shown in FIG. 4. The printhead arrangement is not limited to this, and various arrangements can be applied to the first embodiment. For example, the printhead may be constituted into an integral printhead having two, color and black orifice arrays, like a printhead 501 shown in FIG. 5.

Figure 6A:
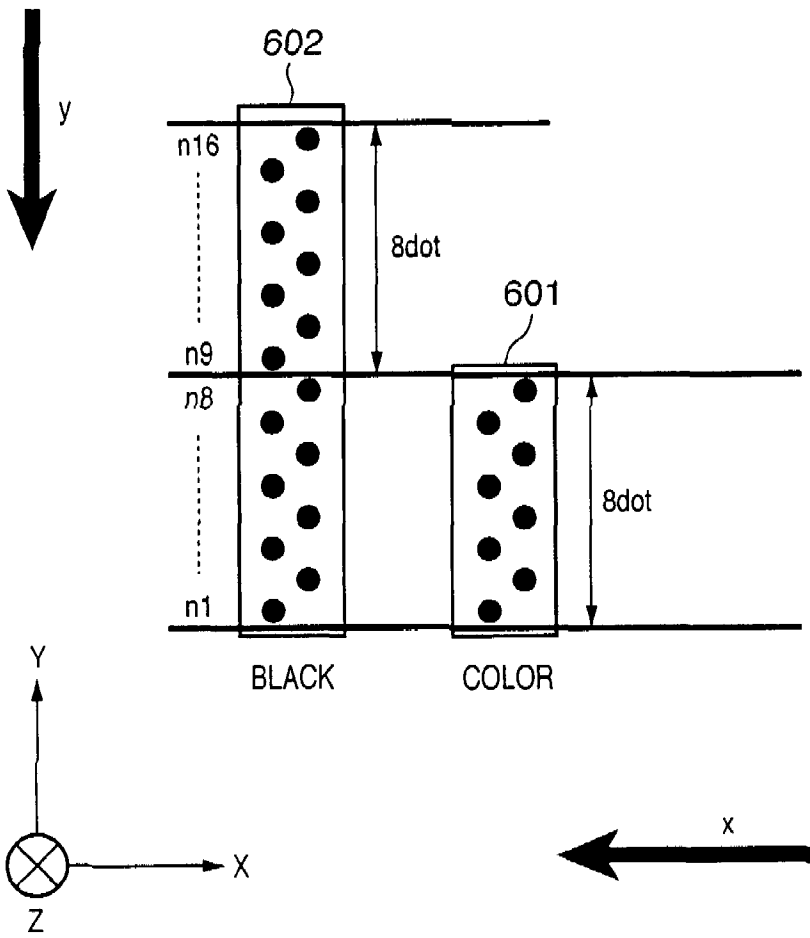
FIGS. 6A and 6B are views showing other arrangements of the printhead which can be applied to the present invention.
Figure 6B:
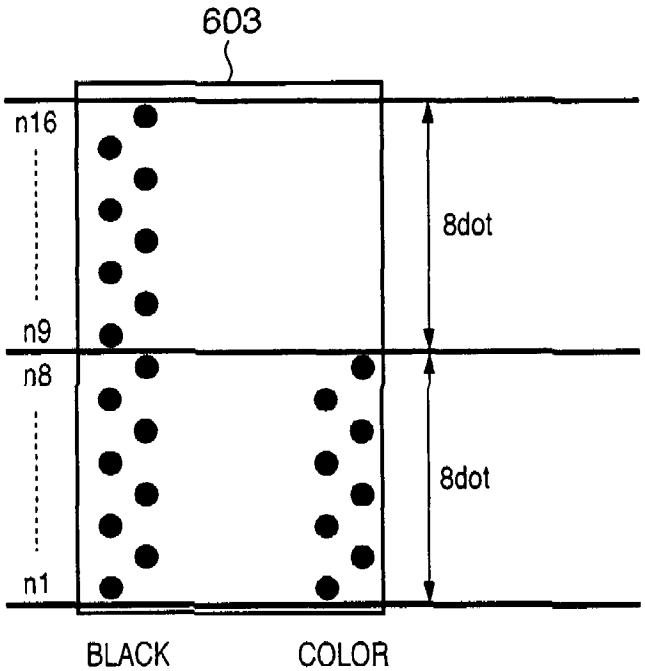

Also, the layout of the orifice array is not limited to the layout shown in FIG. 4. As shown in FIGS. 6A and 6B, odd- and even-numbered orifices may be arrayed on different straight lines.

The arrangement shown in FIG. 6A has two printheads, i.e., a color printhead 601 and black printhead 602, and the even- and odd-numbered orifices of each printhead are staggered (zigzagged). The arrangement shown in FIG. 6B has an integral printhead 603 having a staggered color ink orifice array and staggered black ink orifice array.

In the use of a printhead having an orifice array as shown in FIG. 6A or 6B, letting d be the distance [inch] between an odd-numbered orifice and an even-numbered orifice, and v be the scanning speed [inches/sec] of the printhead in the main scanning direction, a driving signal to the preceding odd-numbered orifice is supplied at a timing earlier by d/v [sec] than a driving signal to the succeeding even-numbered orifice.

Figure 7:
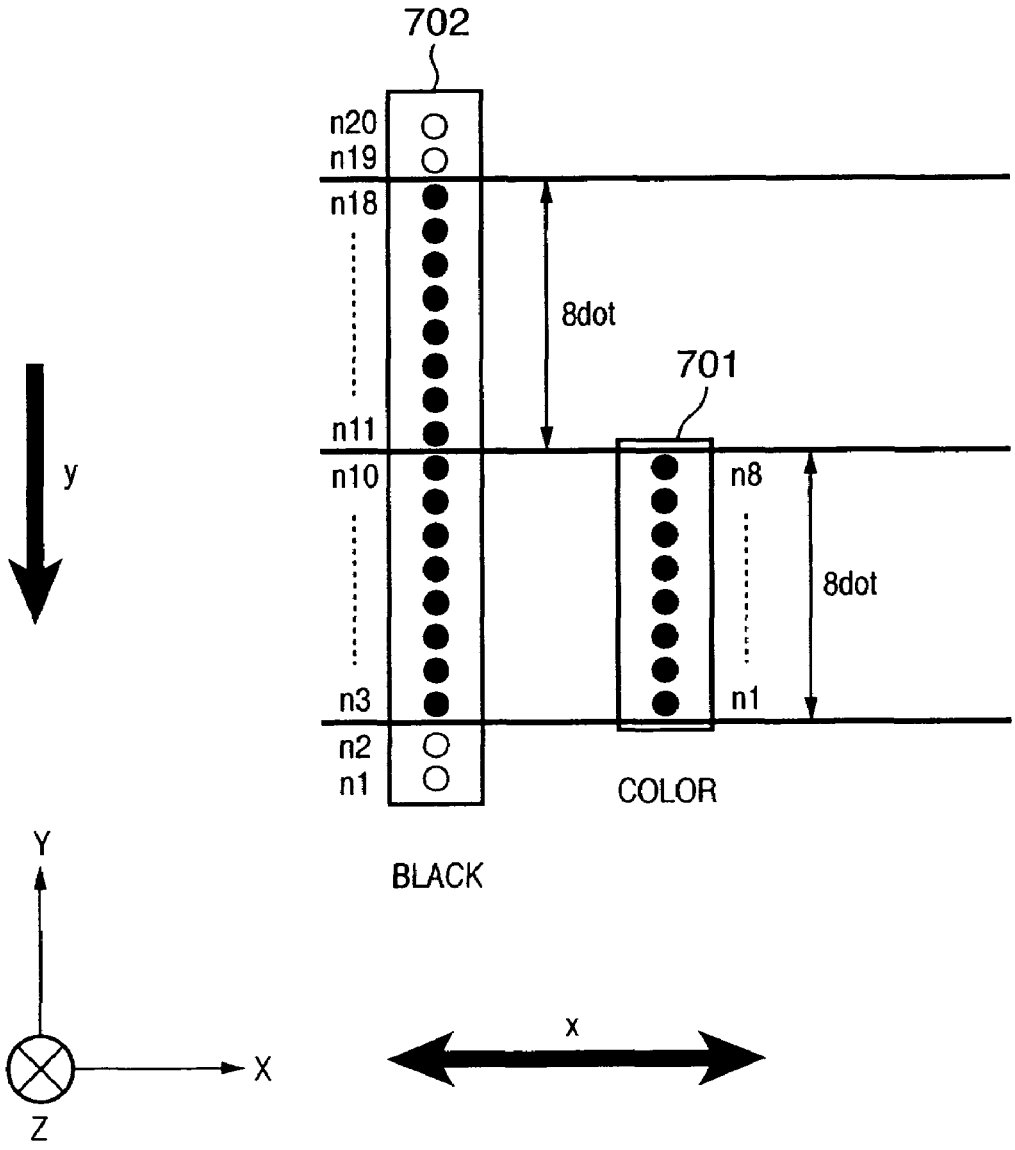
FIG. 7 is a view showing still another arrangement of the printhead which can be applied to the present invention.

The ratio of the numbers of orifices of the color and black printheads is 1:2 in the first embodiment. The present invention can also be applied to an arrangement in which the number of orifices of a black printhead 702 is twice the number of orifices of a color printhead 701, as shown in FIG. 7. In this case, of the orifices of the black printhead 702, 16 orifices n3 to n18 are used for printing, and orifices n1, n2, n19, and n20 are not used for printing. The arrangement of orifices used for printing is the same as the printhead arrangement shown in FIG. 4.

Figure 12:
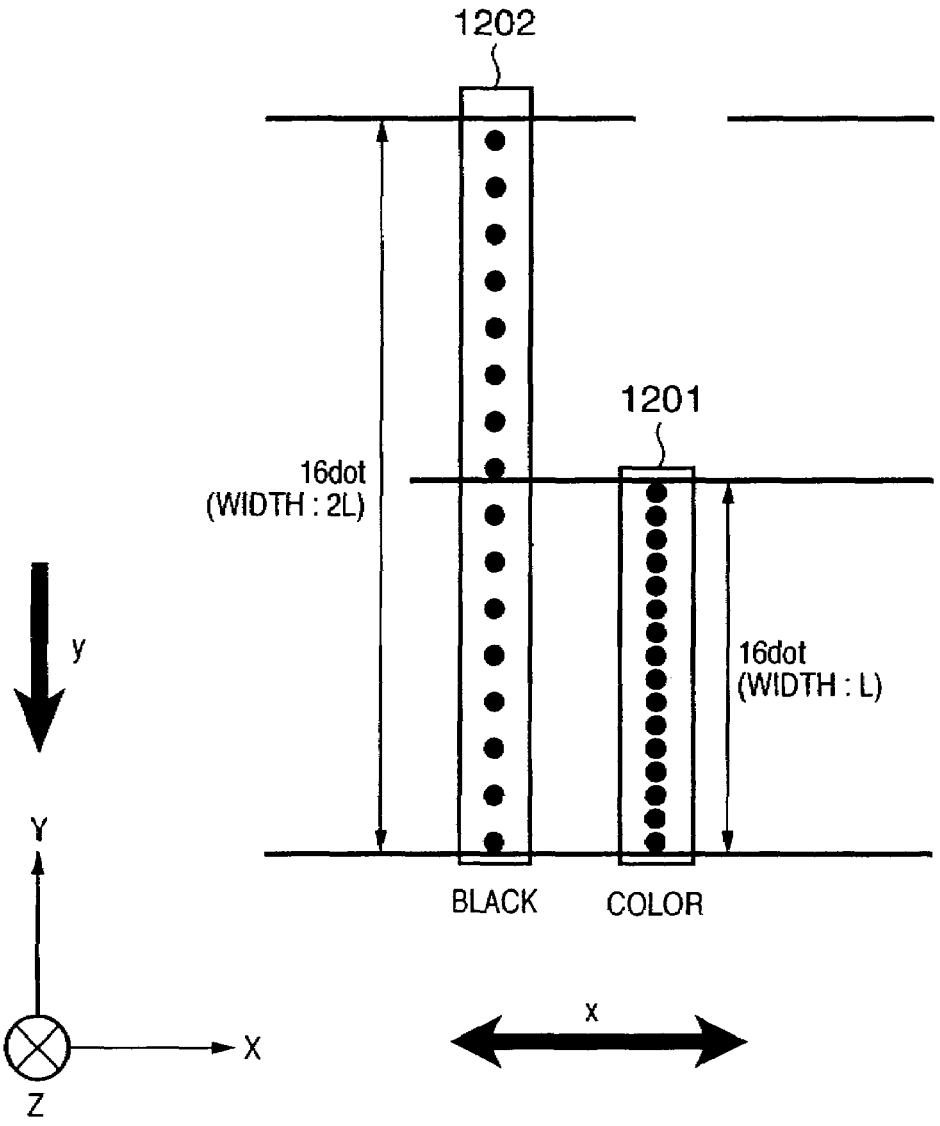
FIG. 12 is a view showing still another arrangement of the printhead which can be applied to the present invention.

The printhead arrangement shown in FIG. 12 has a color ink printhead 1201 in which 16 nozzles are arrayed at a density of 1,200 dpi, and a black ink printhead 1202 in which 16 nozzles are arrayed at a density of 600 dpi. Even if the numbers of nozzles arrayed in the color ink printhead and black ink printhead are equal, the first embodiment can be applied as far as the array densities are different and the sub-scanning widths of regions to be printed by one main scanning are different. In the arrangement shown in FIG. 12, the nozzle pitch of the black ink printhead is twice that of the color ink printhead 1201. However, the first embodiment can be applied even if the nozzle pitch is different three or more times.

As the printhead arrangement used in the first embodiment of the present invention, various arrangements can be adopted as far as the sub-scanning height (length of the nozzle array used for printing) of a region printed in black by one main scanning is twice that of a region printed in color by one main scanning.

(Second Embodiment)

The second embodiment according to the present invention will be described. In the following description, a description of the same parts as those in the first embodiment will be omitted, and the feature of the second embodiment will be mainly explained.

The printhead arrangement used in the second embodiment of the present invention is the same as that described in the first embodiment with reference to FIG. 4. The second embodiment is different from the first embodiment in the printing method.

Figure 9:
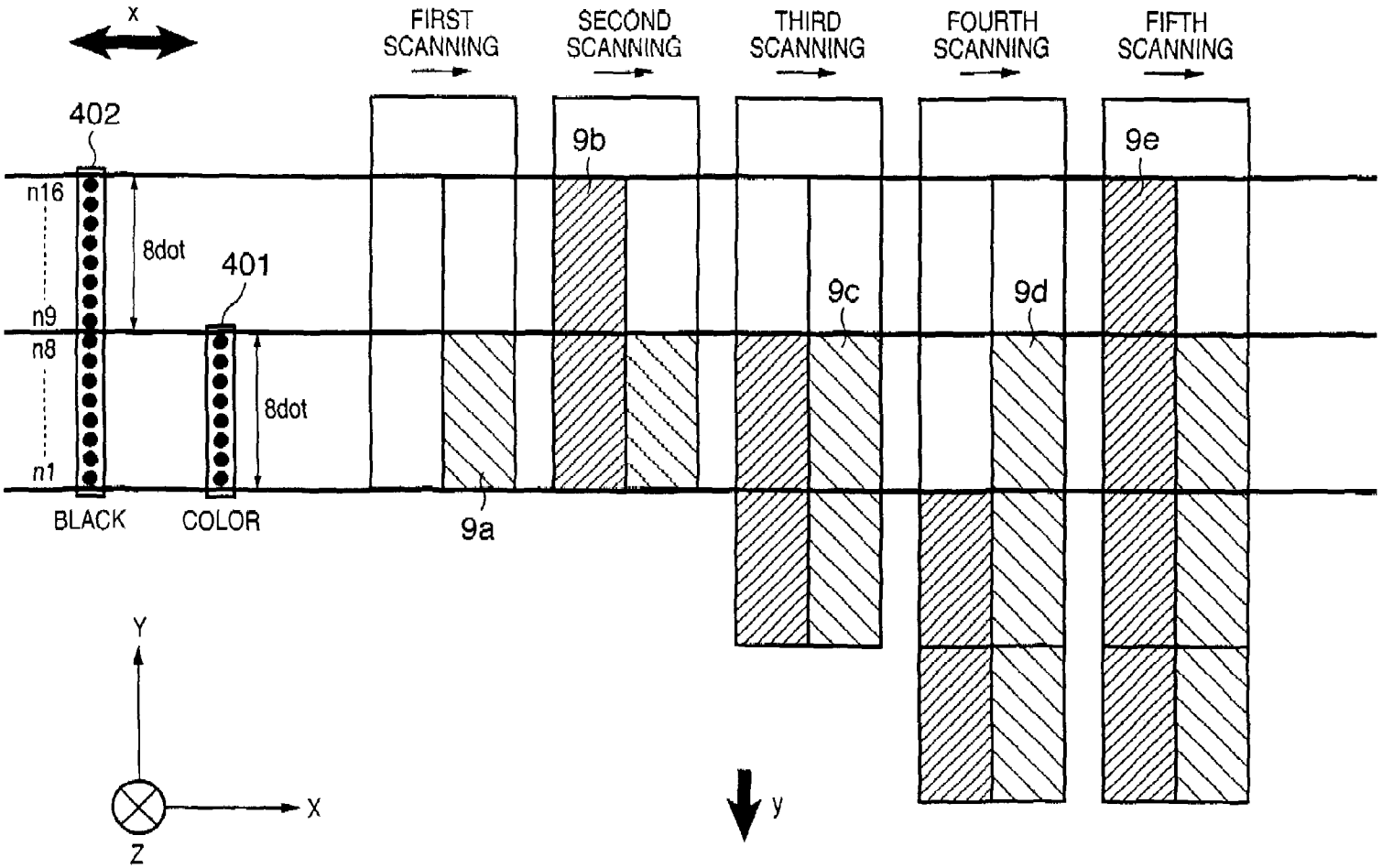
FIG. 9 is a view showing a printing state in each scanning according to the second embodiment of the present invention.

A printing method according to the second embodiment will be explained with reference to FIG. 9 showing a printing state in each scanning.

In the first scanning, a color printing region 9*a* in FIG. 9 is printed by one pass in a forward direction indicated by an arrow using all the eight nozzles of a color ink printhead 401. The printhead is moved in the backward direction so as to return it to the printing start position, and printing is performed in the second scanning without conveying the printing medium in the sub-scanning direction.

In the second scanning, a black printing region 9*b* in FIG. 9 is printed by one pass in a forward direction indicated by an arrow using all the 16 nozzles of a black ink printhead 402. The printhead is moved in the backward direction so as to return it to the printing start position, and the printing medium is conveyed in the sub-scanning direction by driving the sheet feed motor by a distance of 8 dots at 600 dpi.

In the third scanning, a color printing region 9*c* in FIG. 9 is printed by one pass in a forward direction indicated by an arrow using all the eight nozzles of the color ink printhead 401, similar to the first scanning. The printhead is moved in the backward direction so as to return it to the printing start position, and the printing medium is conveyed in the sub-scanning direction by driving the sheet feed motor by a distance of 8 dots at 600 dpi.

In the fourth scanning, a color printing region 9*d* in FIG. 9 is printed by one pass in a forward direction indicated by an arrow using all the eight nozzles of the color ink printhead 401, similar to the third scanning. The printhead is moved in the backward direction so as to return it to the printing start position, and printing is performed in the fifth scanning without conveying the printing medium in the sub-scanning direction.

In the fifth scanning, a black printing region 9*e* in FIG. 9 is printed by one pass in a forward direction indicated by an arrow using all the 16 nozzles of the black ink printhead 402, similar to the second scanning.

According to the second embodiment, either black printing or color printing is performed in each main scanning, and printing is executed in an order of color printing, black printing, and color printing.

As described above, according to the second embodiment, at least two printheads print in different main scanning operations, and even an image in which black and color printing regions are adjacent to each other can be printed at a high speed. Since black and color regions are printed in different main scanning operations, ink blur between the black and color regions is less conspicuous than in a conventional printing method.

Similar to the modification to the first embodiment, the second embodiment can further increase the speed by reciprocal printing in which printing is performed on the return pass in even-numbered main scanning. As for the printhead arrangement used in the second embodiment, various arrangements as those described in the modification to the first embodiment can be employed.

(Third Embodiment)

The third embodiment according to the present invention will be described. In the following description, a description of the same parts as those in the first and second embodiments will be omitted, and the feature of the third embodiment will be mainly explained.

In the first and second embodiments, the ratio of the numbers of orifices of the color and black printheads is 1:2. In the third embodiment, the ratio of the numbers of orifices is 1:3.

Figure 10:
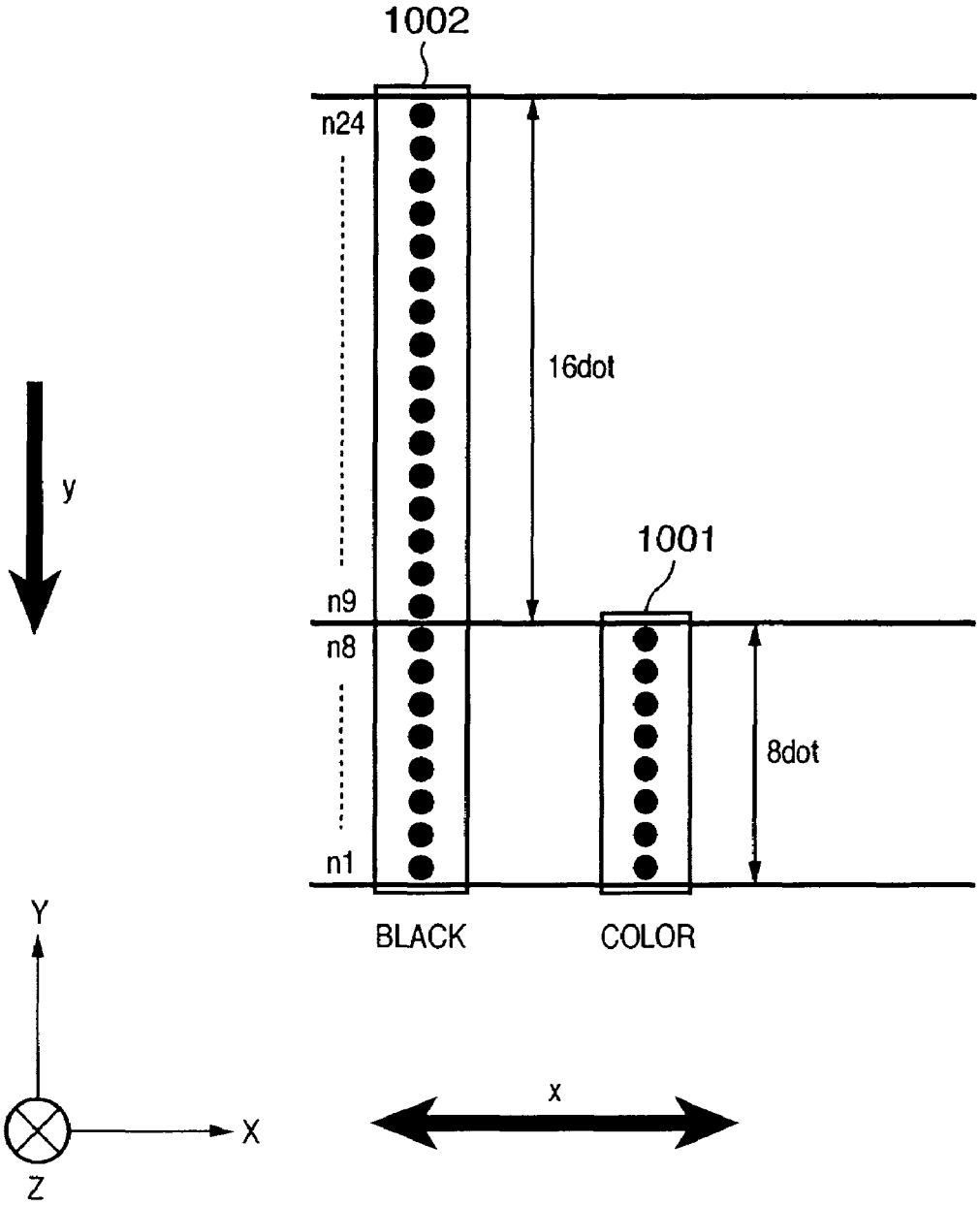
FIG. 10 is a view showing the arrangement of a printhead according to the third embodiment of the present invention.

FIG. 10 is a view showing the arrangement of a printhead according to the third embodiment of the present invention. As shown in FIG. 10, the third embodiment employs two printheads, i.e., a color ink printhead 1001 and black ink printhead 1002. The color ink printhead 1001 has n=8 orifices (8 nozzles) at a density N=600 per inch (600 dpi). The black ink printhead 1002 has n=24 orifices (24 nozzles) at a density N=600 per inch (600 dpi).

Figure 11:
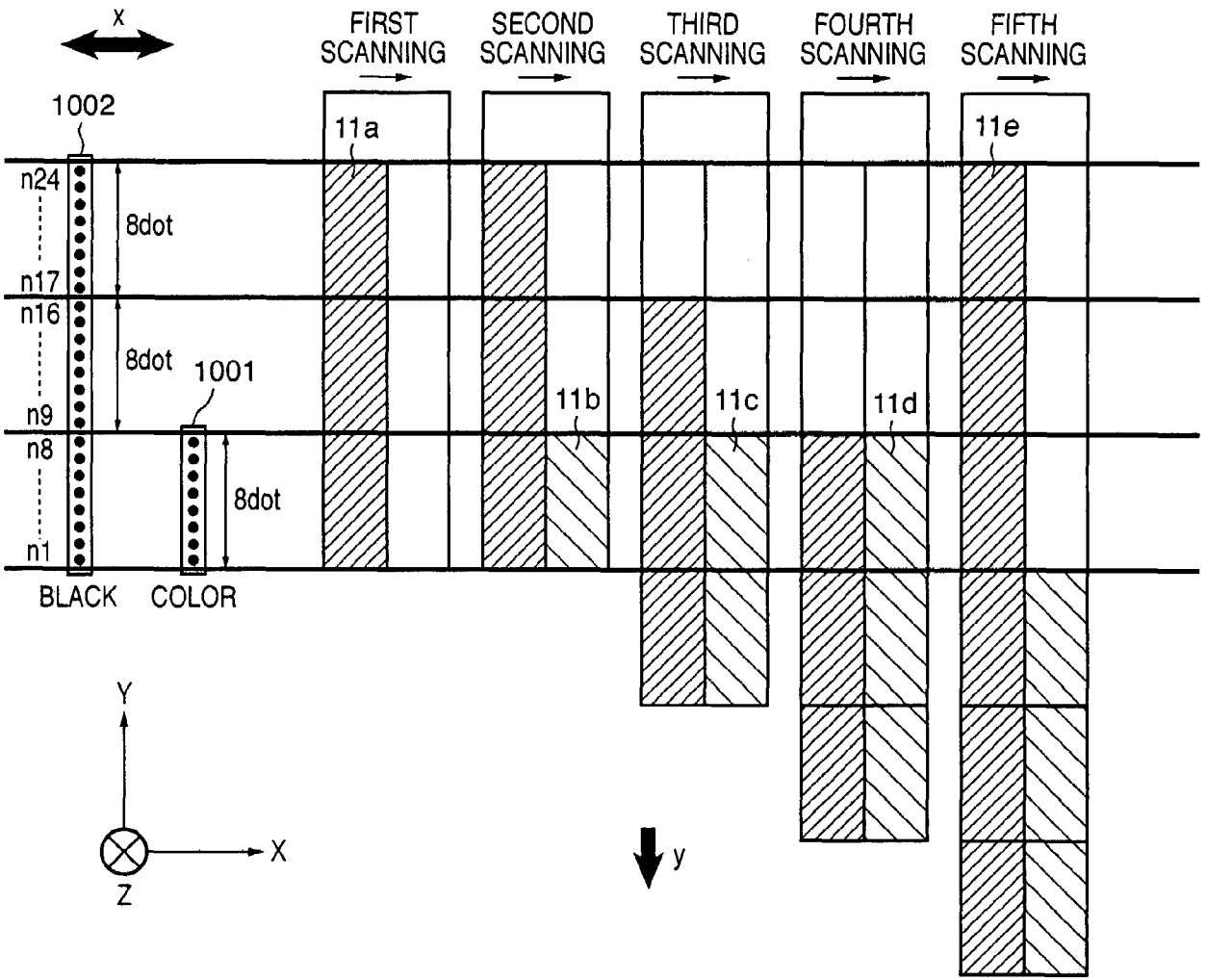
FIG. 11 is a view showing a printing state in each scanning according to the third embodiment of the present invention.

A printing method using the printheads with the above arrangement according to the third embodiment of the present invention will be explained with reference to FIG. 11 showing a printing state in each scanning.

In the first scanning, a black printing region 11*a* in FIG. 11 is printed by one pass in a forward direction indicated by an arrow using all the 24 nozzles of the black ink printhead 1002. The printhead is moved in the backward direction so as to return it to the printing start position, and printing is performed in the second scanning without conveying the printing medium in the sub-scanning direction.

In the second scanning, a color printing region 11*b* in FIG. 11 is printed by one pass in a forward direction indicated by an arrow using all the eight nozzles of the color ink printhead 1001. The printhead is moved in the backward direction so as to return it to the printing start position, and the printing medium is conveyed in the sub-scanning direction by driving the sheet feed motor by a distance of 8 dots at 600 dpi.

In the third scanning, a color printing region 11*c* in FIG. 11 is printed by one pass in a forward direction indicated by an arrow using all the eight nozzles of the color ink printhead 1001, similar to the second scanning. The printhead is moved in the backward direction so as to return it to the printing start position, and the printing medium is conveyed in the sub-scanning direction by driving the sheet feed motor by a distance of 8 dots at 600 dpi.

In the fourth scanning, a color printing region 11*d* in FIG. 11 is printed by one pass in a forward direction indicated by an arrow using all the eight nozzles of the color ink printhead 1001, similar to the second and third scanning operations. The printhead is moved in the backward direction so as to return it to the printing start position, and the printing medium is conveyed in the sub-scanning direction by driving the sheet feed motor by a distance of 8 dots at 600 dpi.

In the fifth scanning, a black printing region 11*e* in FIG. 11 is printed by one pass in a forward direction indicated by an arrow using all the 24 nozzles of the black ink printhead 1002, similar to the first scanning.

According to the third embodiment, the length of the orifice array of the black ink printhead is three times that of the color ink printhead. When a printing medium is conveyed, a region printed in one printing/scanning operation by the black ink printhead and a region printed in three printing/scanning operations by the color ink printhead are formed with the same size by using the two printheads in which orifices having the same number are arrayed from the start position. Printing of a black region and printing of a color region with the same size are alternately executed. In each main scanning, printing is done using only either black or color ink. In the third embodiment, printing is performed in an order of black printing, color printing, color printing, and color printing.

In the third embodiment, black ink having a small Ka value in the Bristow method is applied to a printing medium prior to color ink having a large Ka value in the Bristow method. This improves permeability and fixation on a printing medium, and ink blur between the black and color regions can be effectively prevented.

As described above, according to the third embodiment, at least two printheads print in different main scanning operations, and even an image in which black and color printing regions are adjacent to each other can be printed at a high speed and high quality.

Similar to the modification to the first embodiment, the third embodiment can further increase the speed by reciprocal printing in which printing is performed on the return pass in even-numbered main scanning. As for the printhead arrangement used in the third embodiment, various arrangements as those described in the modification to the first embodiment can be employed.

(Other Embodiment)

The above embodiments assume that an image to be printed has a portion where a region to be printed by black ink and a region to be printed by color ink are adjacent to each other, and have described a method of printing such portion at a high speed and high quality. An image free from such portion may be printed by a conventional printing method. For this purpose, the printing apparatus preferably comprises a means for determining whether an image to be printed has a portion where a region to be printed by black ink and a region to be printed by color ink are adjacent to each other.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy. According to this ink-jet printer and printing method, a high-density, high-precision printing operation can be attained.

The present invention can be applied to a system comprising a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments being realized by executing the program codes which are read by a computer, the present invention also includes a case where an OS (operating system) or the like working on the computer performs parts or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part or entire process in accordance with designations of the program codes and realizes functions of the above embodiments.

As is apparent, many different embodiments of the present invention can be made without departing from the spirit and scope thereof, so it is to be understood that the invention is not limited to the specific embodiments thereof except as defined in the appended claims.

What is claimed is:

1. An ink-jet printing apparatus which prints on a printing medium by performing a printing operation by scanning a printhead unit having a first nozzle array on which a plurality of nozzles for discharging a first ink are arrayed and a second nozzle array on which a plurality of nozzles for discharging a second ink are arrayed on the printing medium along a main scanning direction crossing to a direction of the first and second nozzle arrays, and a conveying operation of the printing medium along a sub-scanning direction crossing to the main scanning direction, wherein the first nozzle array and the second nozzle array are arranged side by side along the main scanning direction so as to locate the nozzles of each of the first and second nozzle arrays at the same position in a convey direction of the printing medium, and the length of the second nozzle array is an integer multiple of the length of the first nozzle array, and the apparatus comprises printing control means for printing an image by combining steps of discharging the first ink into a first area of the printing medium using only the first nozzle array, conveying the printing medium in the sub-scanning direction by a distance corresponding to the length of the first nozzle array, and discharging the second ink into second area of the printing medium using only the second nozzle array where the first and second areas of the printing medium are not substantially overlapped with each other.

2. The apparatus according to claim 1, wherein said printing control means prints an image by scanning in both forward and backward directions.

3. The apparatus according to claim 1, wherein the nozzle which discharges the second ink is large in discharge amount for one operation than the nozzle which discharges the first ink.

4. The apparatus according to claim 1, wherein the second ink is smaller in permeability to a printing medium than the first ink.

5. The apparatus according to claim 4, wherein a Ka value of the second ink in a Bristow method is smaller than a Ka value of the first ink in the Bristow method.

6. The apparatus according to claim 1, wherein the Second ink includes black ink, and the first ink includes ink for color printing.

7. The apparatus according to claim 1, wherein the number of nozzles of the second nozzle array is twice the number of nozzles of the first nozzle array.

8. The apparatus according to claim 7, wherein said printing control means prints an image by sequentially performing the second printing operation, the first printing operation, conveyance of the printing medium by the distance, the first printing operation, and conveyance of the printing medium by the distance.

9. The apparatus according to claim 7, wherein said printing control means prints an image by sequentially performing the first printing operation, the second printing operation, conveyance of the printing medium by the distance, the first printing operation, and conveyance of the printing medium by the distance.

10. The apparatus according to claim 1, wherein the ink-jet printing apparatus further comprises determination means for determining whether an image to be printed has a portion where a region to be printed by the first ink and a region to be printed by the second ink are adjacent to each other, and when said determination means determines that the portion where the regions are adjacent to each other exists, image printing by said printing control means is performed.

11. An ink-jet printing method of printing on a printing medium by performing a printing operation by scanning a printhead unit in a main scanning direction and by performing a conveying operation of a printing medium along a sub-scanning direction crossing to the main scanning direction, wherein the printhead includes a first nozzle array on which a plurality of nozzles for discharging a first ink are arrayed and a second nozzle array on which a plurality of nozzles for discharging a second ink are arrayed along the main scanning direction crossing a direction of the first and second nozzle arrays, the first nozzle array and the second nozzle array are arranged side by side along a direction crossing the direction of the first and second nozzle arrays so as to locate the nozzles of each of the first and second nozzle arrays at the same position in the sub-scanning direction of the printing medium, and the length of the second nozzle array is an integer multiple of the length of the first nozzle array, the method comprising:

printing an image by combining steps of discharging the first ink into a first area of the printing medium using only the first nozzle array, conveying the printing medium in the sub-scanning direction by a distance corresponding to the length of the first nozzle array, and discharging the second ink into a second area of the printing medium using only the second nozzle array where the first and second areas of the printing medium are not substantially overlapped with each other.

12. An ink-jet printing apparatus which prints on a printing medium by performing a printing operation by scanning a printhead unit having a first nozzle array on which a plurality of nozzles for discharging a first ink are arrayed and a second nozzle array on which a plurality of nozzles for discharging a second ink are arrayed on the printing medium along a main scanning direction crossing to a direction of the first and second nozzle arrays, and a conveying operation of the printing medium along a sub-scanning direction crossing to the main scanning direction, wherein the first nozzle array and the second nozzle array are arranged side by side along the main scanning direction so as to locate the nozzles of each of the first and second nozzle arrays at the same position in a convey direction of the printing medium, and the length of the second nozzle array in the sub-scanning direction is an integer multiple of the length of the first nozzle array in the sub-scanning direction, and the apparatus comprises printing control means for printing an image by combining steps of discharging the first ink into a first area of the printing medium using only the first nozzle array, conveying the printing medium in the sub-scanning direction by a distance corresponding to the length of the first nozzle array in the sub-scanning direction, and discharging the second ink into a second area of the printing medium using only the second nozzle array where the first and second areas of the printing medium are not substantially overlapped with each other.

13. An ink-jet printing method of printing on a printing medium by performing a printing operation by scanning a printhead unit in a main scanning direction and by performing a conveying operation of the printing medium along a sub-scanning direction crossing to the main scanning direction, wherein the printhead includes a first nozzle array on which a plurality of nozzles for discharging first ink are arrayed and a second nozzle array on which a plurality of nozzles for discharging second ink are arrayed along the main scanning direction, the first nozzle array and the second nozzle array are arranged side by side in the main scanning direction crossing to a direction of the first and second nozzle arrays so as to locate the nozzles of each of the first and second nozzle arrays at the same position in the sub-scanning direction of the printing medium, and the length of the second nozzle array in a sub-scanning direction crossing to the main scanning direction is an integer multiple of the length of the first nozzle array in the sub-scanning direction, the method comprising:

printing an image by combining steps of discharging the first ink into a first area of the printing medium using only the first nozzle array, conveying the printing medium in the sub-scanning direction by a distance corresponding to the length of the first nozzle array in the sub-scanning direction, and discharging the second ink into a second area of the printing medium using only the second nozzle array where the first and second areas of the printing medium are not substantially overlapped with each other.

* * * * *